US007988519B2

(12) United States Patent
Eckerman et al.

(10) Patent No.: US 7,988,519 B2
(45) Date of Patent: Aug. 2, 2011

(54) APPARATUS, METHOD, AND COMPUTER PROGRAM PRODUCT FOR TOY VEHICLE

(75) Inventors: Scott Eckerman, Campbell, CA (US); Phillip H. Neal, San Rafael, CA (US)

(73) Assignee: Go Products, Inc., Greenbrae, CA (US)

( * ) Notice: Subject to any disclaimer, the term of this patent is extended or adjusted under 35 U.S.C. 154(b) by 1677 days.

(21) Appl. No.: 11/163,769

(22) Filed: Oct. 29, 2005

(65) Prior Publication Data

US 2006/0099882 A1 May 11, 2006

Related U.S. Application Data

(60) Provisional application No. 60/626,010, filed on Nov. 8, 2004.

(51) Int. Cl.
*A63H 30/00* (2006.01)

(52) U.S. Cl. ..... 446/175; 446/409; 446/431; 446/465

(58) Field of Classification Search ..... 446/431, 446/409, 465, 436
See application file for complete search history.

(56) References Cited

U.S. PATENT DOCUMENTS

| | | | | |
|---|---|---|---|---|
| 4,219,962 | A | 9/1980 | Dankman | |
| 4,272,916 | A * | 6/1981 | Giordano et al. | 446/270 |
| 4,813,907 | A * | 3/1989 | Rissman et al. | 446/175 |
| 4,964,837 | A | 10/1990 | Collier | |
| 4,976,650 | A * | 12/1990 | Watanabe | 446/418 |
| 4,993,383 | A | 2/1991 | Wokan | |
| 4,997,404 | A | 3/1991 | May | |
| 5,045,016 | A | 9/1991 | Stern | |
| 5,292,275 | A | 3/1994 | Swisher | |
| 5,413,518 | A * | 5/1995 | Lin | 446/454 |
| 6,033,285 | A * | 3/2000 | Fine et al. | 446/465 |
| 6,250,987 | B1 * | 6/2001 | Choi | 446/436 |
| 6,361,393 | B1 | 3/2002 | Seymour | |
| 6,368,176 | B1 * | 4/2002 | Lozowski et al. | 446/397 |
| 6,491,566 | B2 | 12/2002 | Peters | |
| 6,632,122 | B2 * | 10/2003 | Klitsner et al. | 446/484 |
| 6,663,463 | B1 * | 12/2003 | Dougherty et al. | 446/409 |
| 6,699,097 | B2 * | 3/2004 | Rudell et al. | 446/297 |
| 6,776,686 | B2 * | 8/2004 | Todokoro | 446/454 |
| 6,881,122 | B2 * | 4/2005 | Bloch et al. | 446/466 |
| 2001/0051488 | A1 * | 12/2001 | Tachau et al. | 446/397 |
| 2002/0111116 | A1 * | 8/2002 | Rudell et al. | 446/436 |
| 2003/0222404 | A1 * | 12/2003 | Estrada et al. | 273/440 |

FOREIGN PATENT DOCUMENTS

FR 2625446 A1 7/1989

* cited by examiner

*Primary Examiner* — David L Lewis
*Assistant Examiner* — Chase Leichliter
(74) *Attorney, Agent, or Firm* — Michael E. Woods

(57) ABSTRACT

An apparatus, method, and computer program product for an interactive toy vehicle that provides new structures and combinations of features for enhancing education and amusement, particularly for an improved small-scale vehicle toy that produces feedback (e.g., sounds or lights and a motorized output event) directly related to the amount of a child's input. The apparatus, method, and computer program product for a toy vehicle includes: a chassis; a motive element, coupled to the chassis, for moving the chassis; an impulse detector for generating an impulse signal responsive to one or more impulses applied to the chassis; and a controller, coupled to the chassis and responsive to the impulse signal, for: counting a number N of impulse signals received during a setup period; determining an operational mode responsive to the number N; setting a duty mode for the motive element responsive to the operational mode.

17 Claims, 4 Drawing Sheets

APPARATUS, METHOD, AND COMPUTER PROGRAM PRODUCT FOR TOY VEHICLE

CROSS REFERENCE TO RELATED APPLICATIONS

This Application claims the benefit of U.S. Provisional Application 60/626,010 filed on Nov. 8, 2004.

BACKGROUND OF THE INVENTION

The present invention relates generally to children's toys, and more specifically to interactive motorized toy vehicles.

Toys for children, particularly very young children, cover a great range of options, systems, processes, and implementations. There are many indicia by which toys for children are measured and gauged but it is not generally the case that a single toy is represented as being a single universal toy that satisfies all needs for all children for all times and activities.

There are broad classes of toys, one popular toy class includes small-scale hand-held vehicles, both fanciful and reproductions of real vehicles. Common indicia by which toy vehicles are evaluated include a degree of engagement suggested by levels of interactivity and feedback, as well as ruggedness and opportunities to teach various cognitive and motor skills.

Children, particularly young boys, enjoy small scale, electronic vehicle-themed toys that make sounds, flash lights and race across the floor in some fashion. Young children also enjoy toys that engage them physically, and provide them with a feedback loop based on their physical input. Caregivers of these children also appreciate these kinds of physically engaging toys for their children, as they give a child an outlet for burning off energy that might otherwise be directed toward less beneficial pre-adolescent endeavors. However, more typically, electronic vehicle toys require minimal physical interactivity to operate. For example, the most prevalent input means for activating most electronic toys is a simple push button interface. For a younger child, this simple button interface is relatively easy to master and may become uninteresting as it becomes unchallenging. Children, even young children, are often also capable of basic gross motor coordination activities like jumping, running, spinning, and shaking. Given a choice between pushing buttons and more immersive (and exhaustive) physical activity, most children would choose the latter (as would their caregivers).

Racing vehicles with sounds and lights and motors are well known. There are vehicles that flash lights, make vehicle sounds and roll across the floor. These input means range from having child simply push buttons, touch a sensor, or even yell into a microphone, to activate the lights or sounds or motor. There are also plenty of examples of electronic non-vehicle toys that use motion based input techniques as an alternative to the ubiquitous push button inputs as a means to trigger sounds or lights. These types of motion-triggered toys include: electronic balls, ride-on toys, flying toys, pull along toys and electronic games.

There are ride-on toys that provide sound effects in direct relationship to the amount of input of the rider (sound effect determined on how "big" a rock the child does). Additionally, there are toys that establish an amount of time a toy operates dependent on an amount of time a button is pushed as an input means.

There are a number of drawbacks to current small-scale electronic vehicles options for children. These vehicles require relatively little physical engagement of the child with the toy in order to get the desired output. Most typically, a child merely pushes a button, or a series of buttons to hear sounds, or see lights or make the car drive off. Even in toys that provide progressive sounds and lights with each push of a button, there is little satisfaction in this type of repetitive activity. Further, current offerings don't offer a relationship between the amount of input activity generated and the output event.

There is a need for an improved small-scale vehicle toy that produces feedback (e.g., sounds or lights and a motorized output event) directly related to the amount of a child's input. For example, a toy that provides a sequence of sound effects in a handheld toy that progresses dependent on how many times the toy is shaken in given cycle or a toy that determines a speed at which the toy runs in a time interval dependent on how many times the toy is shaken in a given cycle.

There are also currently "battery-less" flashlights that "power up" by virtue of physical input by shaking them vigorously in order to power them for a period of time (using a Faraday effect). However, this technique is limited in its application to toys because of the high amount of shaking required of a child in order to get a very limited output (e.g., a single LED light).

The improved vehicle toy utilizes a physical shaking input like these Faraday style flashlights but instead uses an embedded power source and a microprocessor to translate the shaking inputs into a potentially a wide range of electronic outputs. Further, this improved technique provides sounds and lights during the input stage of "power up" that enhance the experience and provide a feedback loop to the child.

New combinations and arrangements of toy features are often developed and advance the quality of the toys and the abilities of such toys to contribute to education and amusement of children.

It is desirable to provide an apparatus, method, and computer program product for an interactive toy vehicle that provides new structures and combinations of features for enhancing education and amusement, particularly for an improved small-scale vehicle toy that produces feedback (e.g., sounds or lights and a motorized output event) directly related to the amount of a child's input.

BRIEF SUMMARY OF THE INVENTION

The present invention includes apparatus, method, and computer program product for an interactive toy vehicle that provides new structures and combinations of features for enhancing education and amusement, particularly for an improved small-scale vehicle toy that produces feedback (e.g., sounds or lights and a motorized output event) directly related to the amount of a child's input.

Disclosed is an apparatus, method, and computer program product for a toy vehicle including: a chassis; a motive element, coupled to the chassis, for moving the chassis; an impulse detector for generating an impulse signal responsive to one or more impulses applied to the chassis; and a controller, coupled to the chassis and responsive to the impulse signal, for: counting a number N of impulse signals received during a setup period; determining an operational mode responsive to the number N; setting a duty mode for the motive element responsive to the operational mode.

The construction, arrangement, and input of this improved vehicle toy encourages a child to physically hold it in their hands and shake over a sufficient time to "start" the vehicle and progress through various audio and light sequences. Audio and light sequences are varied as the child cycles through different levels of "revving" the engine in preparation for racing to encourage longer and more sustained shaking.

Further, the new vehicle toy determines how fast and far the vehicle moves dependent on the amount of shaking of the toy vehicle by the child, with the possibility of providing bonus operational modes (e.g., a "wheelie" or "screeching tires") for shaking sequences that meet or exceed certain thresholds.

The present invention thus provides an apparatus, method, and computer program product for an interactive toy vehicle that provides new structures and combinations of features for enhancing education and amusement, particularly an improved small-scale vehicle toy that produces feedback (e.g., sounds or lights and a motorized output event) directly related to the amount of a child's input.

DETAILED DESCRIPTION OF THE INVENTION

The present invention provides an apparatus, method, and computer program product for an interactive toy vehicle that provides new structures and combinations of features for enhancing education and amusement, particularly an improved small-scale vehicle toy that produces feedback (e.g., sounds or lights and a motorized output event) directly related to the amount of a child's input. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

There are currently "battery-less" flashlights that "power up" by virtue of physical input by shaking them vigorously in order to power them for a period of time (using a Faraday effect). However, this technique is limited in its application to toys because of the high amount of shaking required of a child in order to get a very limited output (e.g., a single LED light). The improved vehicle toy uses a physical shaking input like these Faraday style flashlights but instead uses an embedded power source and a controller (e.g., a microprocessor) to translate the shaking inputs into one or more control signals for a potentially a wide range of electronic outputs. Further, this improved technique provides sounds and lights during the input stage of "power up" that enhance the experience and provide a feedback loop to the child.

Figure 1:
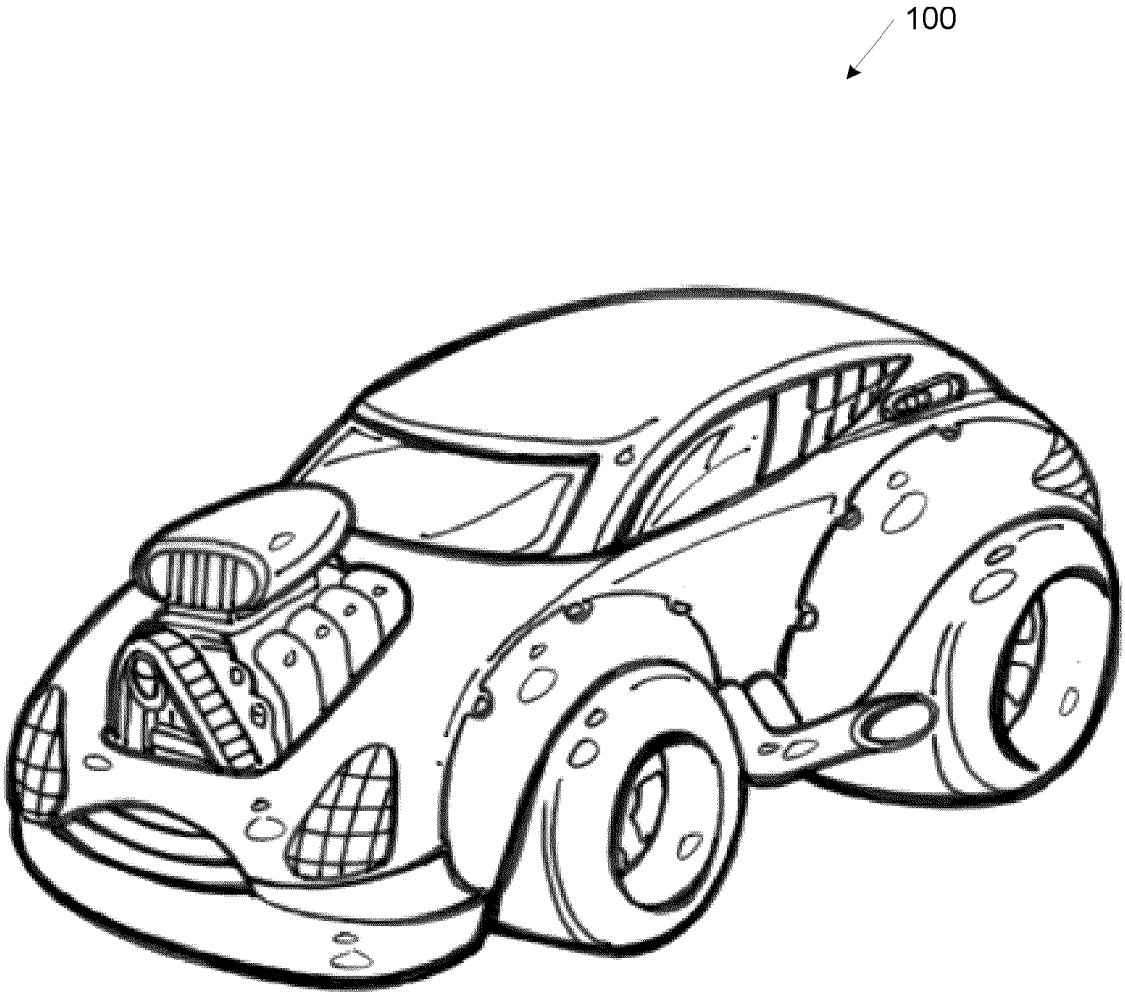
FIG. 1 is a perspective view of a preferred embodiment of the present invention implemented by an interactive toy vehicle.

FIG. 1 is a perspective view of a preferred embodiment of the present invention implemented by an interactive toy vehicle 100. To simplify the following discussion, the preferred embodiment implemented by an "automobile-type" of toy, though various other interactive toys and amusements may include other implementations. In operation, a child picks up and shakes vehicle 100. The number of shakes over various intervals simulates, progressively, starting and reving vehicle 100. Stopping a shaking sequence, prior to actuating vehicle 100, produces an "idle" indication. The child may, at any time, actuate vehicle 100 to cause it to move out at a speed/distance determined by the amount of "shake-induced" charge.

Figure 2:
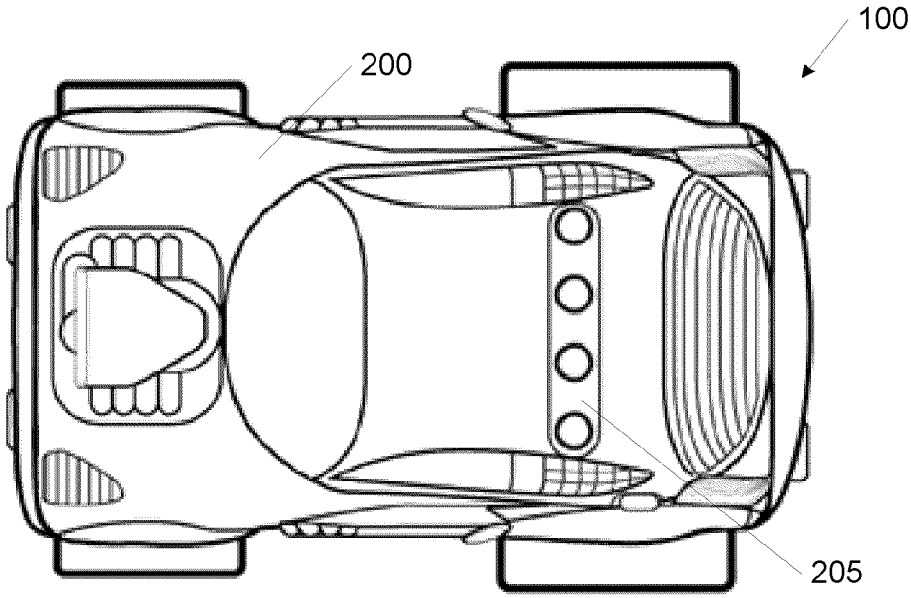
FIG. 2 is a top view of the interactive toy vehicle shown in FIG. 1.

FIG. 2 is a top view of interactive toy vehicle 100 shown in FIG. 1 including a body 200 and an LED array 205. Body 200 provides a "look and feel" of small-scale vehicle, sometimes fanciful and sometimes a replica (of varying degrees of fidelity) of actual vehicles with which the child may be familiar (e.g., a police car, fire truck, ambulance, bulldozer, etc.). LED array 205 provides a visual cue as to a degree of "virtual charging" of vehicle 100 responsive to the shaking. In the preferred embodiment, there are five modes indicated by the four LEDs of LED array 205. The five modes include "OFF" and four "ON" modes. Each ON mode progressively faster than a previous mode. LED 205 thus indicates these five modes by the number and pattern of illuminated LEDS: OFF has no LEDs illuminated, ON-1 has a single LED illuminated, ON-2 has two LEDs illuminated. Preferably the LEDs of LED array 205 are illuminated to produce a "progress" bar in which successive LEDs are illuminated to indicate higher levels of virtual charging. In some implementations, LED array 205 may include differing LED colors to provide feedback of the operational mode.

Figure 3:
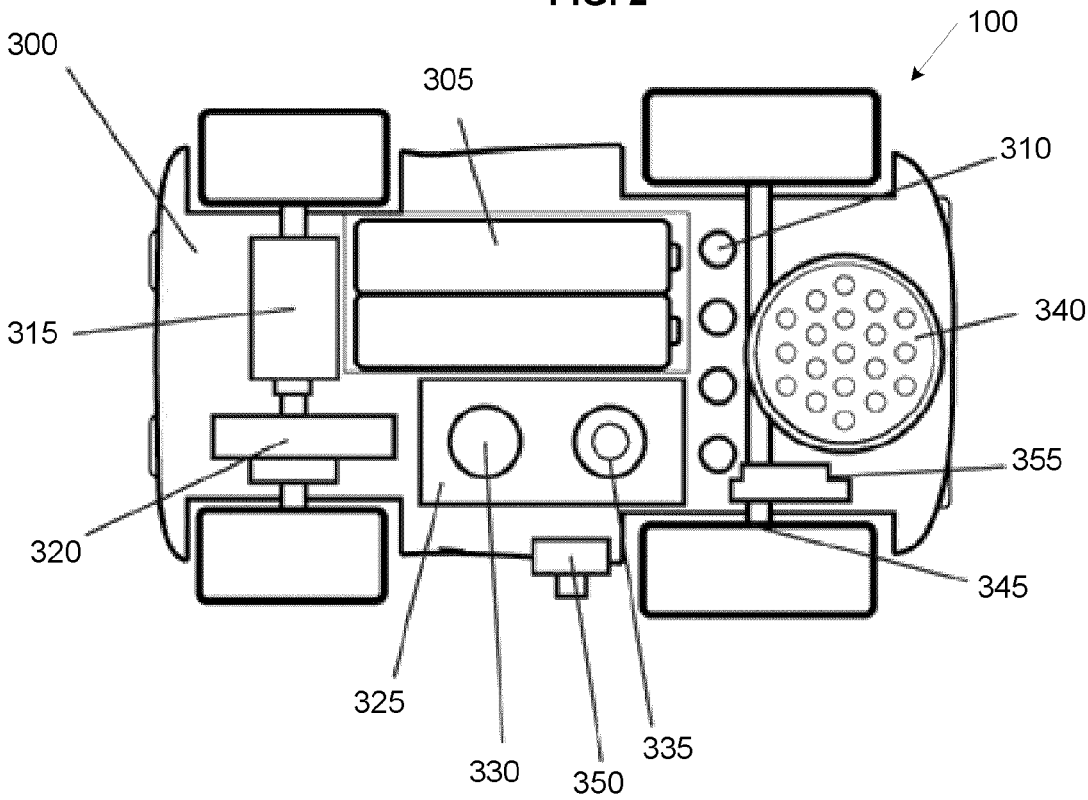
FIG. 3 is a top view of the interactive toy vehicle shown in FIG. 2 with the body removed.

FIG. 3 is a top view of interactive toy vehicle 100 shown in FIG. 2 with body removed 200. Vehicle 100 includes a chassis 300 and the following elements coupled to chassis 300: a power source 305, a visual feedback indication system 310 (e.g., LED array 205), a motor 315, a gear box 320, a printed circuit board (PCB) 325, a controller 330, an impulse detector 335, an audio feedback indication system 340, a plurality of wheels/axels 345, an ON/OFF switch 350, and an actuation switch 355.

Chassis 300 is a toy housing or casing configured into the desired toy/amusement object, which in the preferred embodiment is a toy automobile. Other embodiments may be other types of vehicles—including trains, watercraft or aircraft and in other embodiments may also be a ball or bumble-ball type housing.

Power source 305, e.g., one or more batteries, provides power to add sound, lights and logic to vehicle 100.

Visual feedback system 310 indicates level of "power up" or "virtual charge" and also used for enhanced light effect at key moments (e.g., motor "start" and "peel out" sequence). Visual feedback system 310 may include different/additional visual elements other than single LED array 205 depending upon a particular implementation.

Motor 315 is an electric motor used to drive gear box 320 and turn wheels 345 in vehicle 100 responsive to control information from controller 330. In some implementations, motor 315 may also be used to trigger a particular stunt or a bouncing, jiggling ball or an action and then a secondary action (like shaking the motor block or doing a stunt after X duration of motor run).

Gear box 320 is used to moderate and gear down a motor in an output sequence, converting rotation of an element of motor 315 to appropriate rotation of one or more wheels/axels of wheels/axel 345.

PCB 325, as conventionally known, provides structural and electrical interconnectivity among the elements of vehicle 100.

Controller 330, e.g., a microprocessor, provides logic for measuring input conditions and an output based on input registered as more fully described below. In a preferred embodiment, controller 330 is a microcontroller that includes embedded memory and interface elements to function as a specially programmed general purpose computing system. In some implementations, the interface includes I/O elements for affecting the program instructions stored in the embedded memory, and in some instances an interface for accessing removable media storing program instructions for implementing one or more of the features described herein.

Impulse detector 335, e.g., a motion/shake sensor, may be implemented in many different ways. For example, detector 335 may be a simple post/spring jiggle switch, a plastic ball in a cage hitting switches, a gravity switch or any other of well-known or yet-to-be developed mechanisms to produce an impulse signal responsive to impulses (e.g., one or more "shakes") applied to chassis 300.

Audio feedback indication system 340, e.g., a speaker/audio source, provides feedback sound responsive to control information from controller 330 that ties the feedback sound to motion inputs, motor start event, motor output (also may apply to a one or more bonus events like "stunt" events).

Wheels/axel 345, present in the vehicle version format of the present invention, transfers motor/gear sequence into output movement over a surface. Depending upon implementations, wheels/axel 345 may respond to control information from controller 330 to change vehicle direction or orientation (by independently moving one or more individual wheels/axels relative to each other or chassis 300 (e.g., steering or spinning wheels in different directions or bouncing chassis relative to chassis mount). Motor 315, gear box 320, and wheels/axel 345 provide the motive element for the vehicle format. Other formats may configure the motive element differently to be appropriate for the format (e.g., engines and propellers for watercraft and aircraft).

ON/OFF switch 350 is optional but may, in some implementations, be used to power up controller 330 in anticipation of shake input sequence.

Actuation switch 355 is a motion activation switch that triggers motor start and audio sequence when the child intends to transition from "charging" mode to "run" mode. In the preferred embodiment, switch 355 is located near wheels/axel 345 to provide input to controller 330 that the child has set vehicle 100 down on a flat surface. Actuation switch 355 may be a spring-switch that closes in response to vehicle weight on an axel, for example. Switch 355 thus indicates that an input sequence is completed and output sequence should begin.

In operation, a child picks up vehicle 100, scaled appropriately for the relatively small hand size of children, and shakes. Controller 330 detects the shakes using impulse detector 335 and counts the number of shakes over various intervals to establish the operational mode. Controller 330 provides feedback cues to the child, through the visual feedback system 310 and/or audio feedback system 340. When the child stops shaking and sets vehicle 100 down, controller 330 actuates the motive element appropriate for the mode. When the child has satisfied conditions for a bonus mode, those are produced as well using vehicle 100. System 400 provides a short interval after actuator 355 is engaged before starting the motive elements to ensure that the engagement has not resulted inadvertently from shaking. When actuator 355 is engaged and no impulses have been received for the requisite period, controller 330 initiates the motive element appropriate to the operational mode.

Figure 4:
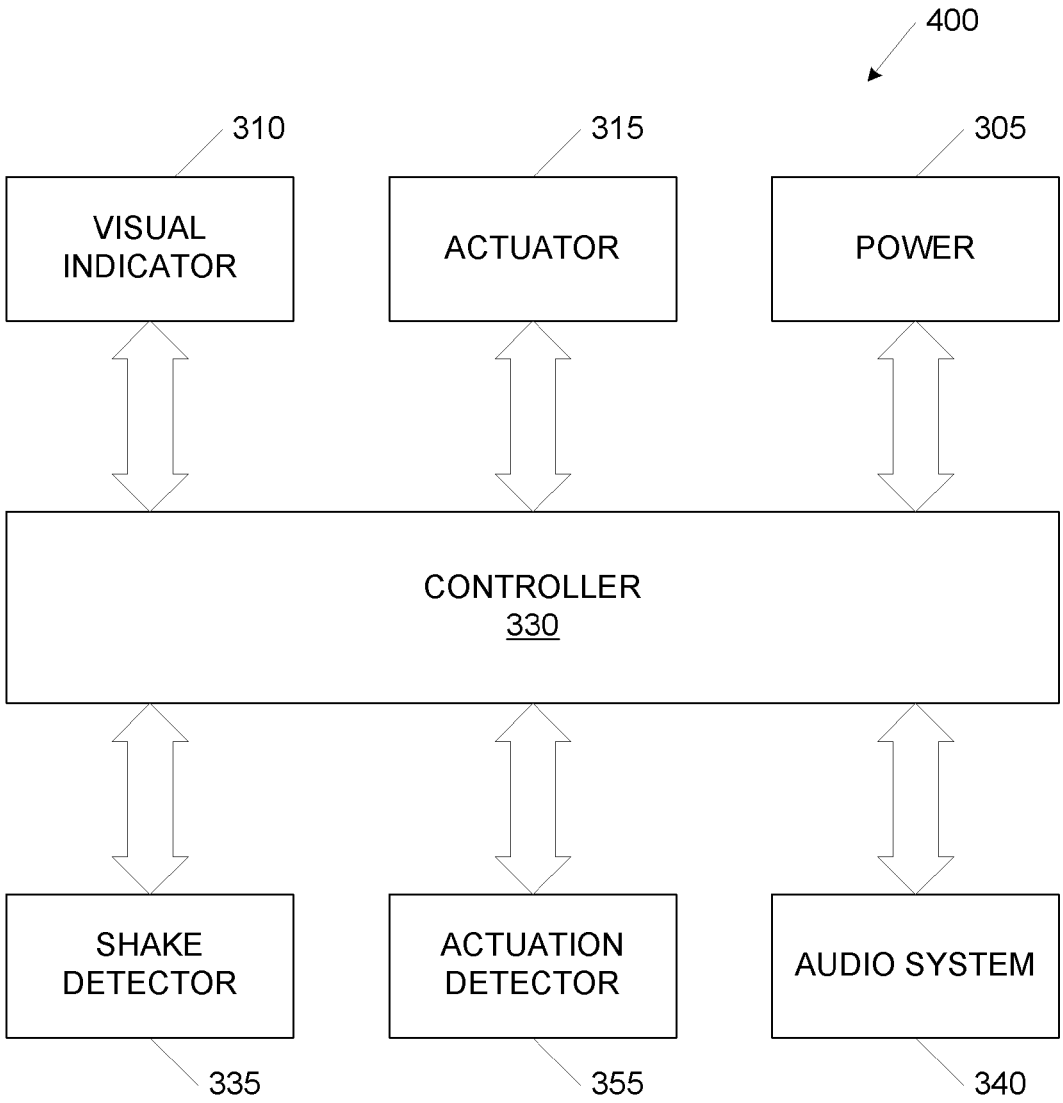
FIG. 4 is a schematic block diagram of the preferred embodiment of the present invention.

FIG. 4 is a schematic block diagram of the preferred embodiment of the present invention for an interactive toy system 400 implementing the functionality of vehicle 100 described above, particularly in conjunction with FIG. 3. Controller 330 monitors shake detector 335 and actuation detection 355 to control the operation of the elements of system 400. The following table, Table I, provides a preferred embodiment of the operational modes and feedback cues of system 400.

TABLE I

| Vehicle States | | | | | | |
|---|---|---|---|---|---|---|
| SHAKE | INT. | MODE | VISUAL | AUDIO | MOTOR | BONUS |
| 0 | 1 | OFF | NONE | NONE | OFF | NONE |
| 1 | 1 | ON-1 | LED-1 ON | SFx-Ignition1 | OFF | NONE |
| 2 | 1 | ON-1 | LED-1 ON | SFx-Ignition2 | ON-25% | NONE |
| >2 | 1 | ON-1 | LED-1 ON | SFx-Rev1 | ON-25% | NONE |
| 1 | 2 | ON-2 | LED-1 ON<br>LED-2 ON | SFx-Rev2 | ON-50% | NONE |
| >1 | 2 | ON-2 | LED-1 ON<br>LED-2 ON | SFx-Rev2 | ON-50% | NONE |
| 1 | 3 | ON-3 | LED-1 ON<br>LED-2 ON<br>LED-3 ON | SFx-Rev2 | ON-75% | NONE |
| >1 | 3 | ON-3 | LED-1 ON<br>LED-2 ON<br>LED-3 ON | SFx-Rev3 | ON-75% | NONE |
| 1 | 4 | ON-4 | LED-1 ON<br>LED-2 ON<br>LED-3 ON<br>LED-4 ON | SFx-Rev4 | ON-100% | "PEEL OUT" |
| >1 | 4 | ON-4 | LED-1 ON<br>LED-2 ON<br>LED-3 ON<br>LED-4 ON | SFx-Rev4 | ON-100% | "PEEL OUT" |
| >N | 4 | ON-4 | LED-1 ON<br>LED-2 ON<br>LED-3 ON<br>LED-4 ON | SFx-Rev4 | ON-100% | "PEEL OUT" plus BONUS |
| None for x seconds | >0 | ON-1 to ON-4 | Note_1 | SFx-Idle | Note_1 | Note_1 |

Note_1 : State is determined appropriate to Mode

As seen from Table I, controller 330 provides numerous visual and audio cues to a child during operation. Of course, other cues or combinations, or thresholds may be implemented different from those shown in Table I. Table I includes seven columns: shake #, interval, mode, visual cue, audio cue, motor mode (when vehicle 100 is actuated in that state) and bonus mode (when vehicle 100 is actuated in that state).

The interval has not been described much prior to its introduction into Table I. System 400 of the preferred embodiment is not simply a "shake counter" with the mode determined exclusively by a total number of shakes. Rather, controller 330 establishes intervals and sets modes and cues based upon a number of shakes during each interval. In the preferred embodiment, each interval is about four-five seconds. Except for some special processing in the first interval (for simulating a "start-up" of vehicle 100) each time a requisite number of shakes (in the preferred embodiment this is a single shake) is recorded in each interval, that mode is locked. In this way, the child does not simply shake vigorously for a short duration, but must shake sufficiently long for the extended or higher level modes (though some implementations may include such metrics in addition to or in replacement of the preferred implementation).

Each mode has an appropriate visual indication and audio indication. At any time that the child actuates vehicle 100, the motor responds based upon the mode. The response in the preferred embodiment is to run for a predetermined period, but at different speeds (achieved by varying the duty cycle of the motor). In other embodiments, the length of motor run is determined by the mode. What is not shown in Table I is that each run mode may also be associated with a different sound effect (SFx) appropriate for the simulated speed.

As shown in Table I, the increasing number of shakes over the appropriate intervals produces a progressive simulation of "virtual charging" with appropriate visual and audio cues. The visual cues include an LED progress bar and the audio cues include sound effects (SFx_<type>) that successively indicate greater charging (more intense or rapid "revving" for example).

In addition to the typical modes, Table I also describes three special cases: startup, idle, and bonus. Start-up mode produces various degrees of ignition sounds in response to initial shakes. A first shakes "turns an engine over" and a second shake received sufficiently close to the first "starts" the engine and thereafter further shakes produce revving and may advance system 400 to higher mode levels. Should a sufficient period pass after this first shake and prior to the second shake, system 400 actually returns to the OFF mode and does not "start" or respond to shakes except as the initial shake number.

Idle mode, indicated by the last row, is simply a simulation that the child has stopped shaking during a particular mode (as measured by a cessation of impulses over a period of time less than the interval duration, about two to four seconds). System 400 produces an "idling" sound effect and will resume "revving" upon a next-received shake.

The bonus mode is an optional mode that further enhances the present invention. In the preferred embodiment, there are numerous opportunities for various bonuses. One bonus is provided simply by reaching the highest level and produces a special light pattern (e.g., flashing LEDs) and a special sound effect (e.g., "peeling out" simulation). An additional, and further optional, bonus is achieved when system 400 detects that a sufficient number of shakes have been received while in the highest level. This bonus produces additional feedback cues (a special combination of lights and/or sound effects) that may shake the engine or other special feature. System 400 may provide for additional/different bonuses that respond to various factors including one or more of a number, duration, magnitude, and speed of shaking. In some implementations, a bonus mode may be indicated based upon whether any bonus modes have been produced over a last number M of vehicle operations as a "surprise" bonus to enhance child engagement.

Figure 5:
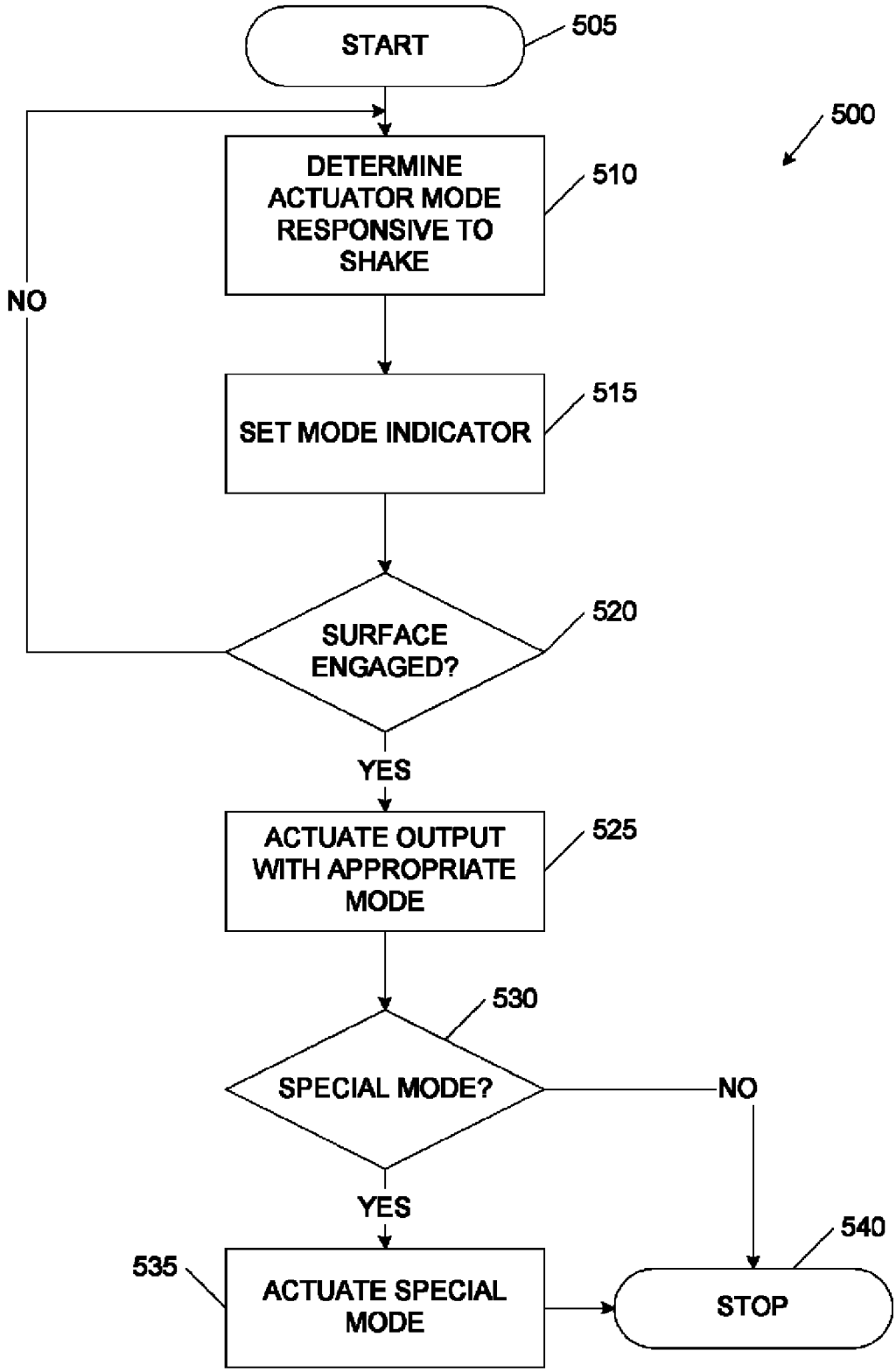
FIG. 5 is flow diagram of a preferred embodiment of the present invention for an operating process.

FIG. 5 is flow diagram of a preferred embodiment of the present invention for an operating process 500 implemented by system 400 for vehicle 100. Process 500 begins with an initiation process 505 that may include turning the optional ON/OFF switch described above to the ON state. Process 500 next at step 510 determines an actuator mode (e.g., motor duty cycle/feedback) responsive to any shaking of vehicle 100 as set forth in Table I. Thereafter at step 515, process 500 sets the various feedback cues (including the audio/visual indicators) as described in Table I.

Process 500 tests whether the child has set vehicle 100 down to transition from the "charging" mode to the "run" mode at step 520. Actuator 355 determines whether the surface (e.g., "roadway") has been engaged by vehicle 100. When the surface has not been engaged (the test at step 520 is negative) then process returns to step 510 to determine the operational mode.

However, when the test at step 520 is affirmative, process 500 advances to step 525 to start the motive element(s) and provide the appropriate feedback cues for the operational mode level. Another test, step 530, is performed after step 525 to determine whether any special mode should be produced. As discussed above, there are many possible bonus modes and tests to determine whether the bonus mode should be produced. When a bonus mode is to be produced, process 500 advances to step 535 to actuate the special mode and then concludes at step 540. When the bonus mode is not to be produced, process 500 advances directly to the conclusion step 540 from step 530. While process 500 has been described in serial fashion, it may be implemented as an interrupt-driven or message-based system to respond to interrupts/messages indicating various states of the input/output elements of vehicle 100.

Various components and subsystems of vehicle 100 have been described specifically for automotive toy vehicles, the preferred embodiment is not limited to these types of vehicles or necessarily to vehicles at all. Terms specific to the feedback systems and the motive system have been used. While these are descriptive of the preferred embodiments, these terms are not to be understood as limiting the nature of the present invention.

There are currently "battery-less" flashlights that "power up" by virtue of physical input by shaking them vigorously in order to power them for a period of time (using a Faraday effect). However, this technique is limited in its application to toys because of the high amount of shaking required of a child in order to get a very limited output (e.g., a single LED light). The improved vehicle toy uses a physical shaking input like these Faraday style flashlights but instead uses an embedded power source and a controller (e.g., a microprocessor) to translate the shaking inputs into one or more control signals for a potentially a wide range of electronic outputs. Further, this improved technique provides sounds and lights during the input stage of "power up" that enhance the experience and provide a feedback loop to the child. In some applications, the shaking may directly control various features through the power level and control based upon an amount of stored charge.

The invention described in this application may, of course, be embodied in hardware; e.g., within or coupled to a Central Processing Unit ("CPU"), microprocessor, microcontroller, System on Chip ("SOC"), or any other programmable device. Additionally, embodiments may be embodied in software (e.g., computer readable code, program code, instructions and/or data disposed in any form, such as source, object or machine language) disposed, for example, in a computer usable (e.g., readable) medium configured to store the software. Such software enables the function, fabrication, modeling, simulation, description and/or testing of the apparatus and processes described herein. For example, this can be accomplished through the use of general programming languages (e.g., C, C++), GDSII databases, hardware description languages (HDL) including Verilog HDL, VHDL, AHDL (Altera HDL) and so on, or other available programs, databases, and/or circuit (i.e., schematic) capture tools. Such software can be disposed in any known computer usable medium including semiconductor, magnetic disk, optical disc (e.g., CD-ROM, DVD-ROM, etc.) and as a computer data signal embodied in a computer usable (e.g., readable) transmission medium (e.g., carrier wave or any other medium including digital, optical, or analog-based medium). As such, the software can be transmitted over communication networks including the Internet and intranets. Embodiments of the invention embodied in software may be included in a semiconductor intellectual property core (e.g., embodied in HDL) and transformed to hardware in the production of integrated circuits. Additionally, implementations of the present invention may be embodied as a combination of hardware and software.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

A "computer-readable medium" for purposes of embodiments of the present invention may be any medium that can contain, store, communicate, propagate, or transport the program for use by or in connection with the instruction execution system, apparatus, system or device. The computer readable medium can be, by way of example only but not by limitation, an electronic, magnetic, optical, electromagnetic, infrared, or semiconductor system, apparatus, system, device, propagation medium, or computer memory.

A "processor" or "process" includes any human, hardware and/or software system, mechanism or component that processes data, signals or other information. A processor may include a system with a general-purpose central processing unit, multiple processing units, dedicated circuitry for achieving functionality, or other systems. Processing need not be limited to a geographic location, or have temporal limitations. For example, a processor may perform its functions in "real time," "offline," in a "batch mode," etc. Portions of processing may be performed at different times and at different locations, by different (or the same) processing systems.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Embodiments of the invention may be implemented by using a programmed general purpose digital computer, by using application specific integrated circuits, programmable logic devices, field programmable gate arrays, optical, chemical, biological, quantum or nanoengineered systems, components and mechanisms may be used. In general, the functions of the present invention may be achieved by any means as is known in the art. Distributed, or networked systems, components and circuits may be used. Communication, or transfer, of data may be wired, wireless, or by any other means.

It will also be appreciated that one or more of the elements depicted in the drawings/figures may also be implemented in a more separated or integrated manner, or even removed or rendered as inoperable in certain cases, as is useful in accordance with a particular application. It is also within the spirit and scope of the present invention to implement a program or code that may be stored in a machine-readable medium or transmitted using a carrier wave to permit a computer to perform any of the methods described above.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

The above-described arrangements of apparatus and methods are merely illustrative of applications of the principles of this invention and many other embodiments and modifications may be made without departing from the spirit and scope of the invention as defined in the claims.

These and other novel aspects of the present invention will be apparent to those of ordinary skill in the art upon review of the drawings and the remaining portions of the specification. Thus, the scope of the invention is to be determined solely by the appended claims.

What is claimed is:

1. A method, the method comprising:

(a) detecting a sequence of discrete child-originated countable shakes applied to a toy vehicle using an impulse detector coupled to said toy vehicle, said sequence including a number N of applied shakes; and (b) responding to said sequence of discrete child-originated countable shakes to provide a feedback indication simulating "charging" said toy vehicle wherein an attribute of said feedback indication is directly related to said number N.

2. The method of claim 1 further comprising including a bonus indication when said sequence satisfies a predetermined threshold number M to indicate at least a full charge by maximizing said attribute of said feedback indication only when said number N exceeds said predetermined threshold number M.

3. The method of claim 1 wherein said attribute of said feedback indication is a particular tier of a plurality of tiers of available feedback indications and wherein each tier of said plurality of tiers includes a different feedback indication for a range of said number N associated with each said tier of said plurality of tiers.

4. A method for operating a toy vehicle, the method comprising the steps of:

(a) determining a particular actuator mode of the toy vehicle responsive to application of a number N shakes to a the toy vehicle, said number of N shakes detected using an impulse detector coupled to said toy vehicle, wherein said actuator mode is selected from one of a predetermined set of actuator modes, and wherein each actuator mode of said set of actuator modes includes a predetermined level of simulated "charge" for said toy vehicle with said particular actuator mode selected directly responsive to said number N to provide a greater predetermined level of charge as N increases; and (b) setting a mode indicator of the toy vehicle responsive to said actuator mode.

5. The method of claim 4 wherein the toy vehicle is held above an operating surface while said number N shakes are applied to the toy vehicle, the method further comprising:

(c) detecting a set-down event for the toy vehicle with the toy vehicle engaging said operating surface after application of said number N shakes; and thereafter (d) actuating automatically a run-mode of the toy vehicle responsive to said actuator mode upon detection of said set-down event.

6. The method of claim 4 wherein said actuator mode includes a duty cycle of a motive structure of the toy vehicle wherein said duty cycle increases as said number N increases.

7. The method of claim 4 wherein said actuator mode includes a feedback indication to an operator shaking the toy vehicle for each applied shake of said number N applied shakes.

8. The method of claim 4 wherein said mode indicator includes a feedback cue to an operator shaking the toy vehicle.

9. The method of claim 8 wherein said feedback cue includes an audio cue.

10. The method of claim 8 wherein said feedback cue includes a visual cue.

11. The method of claim 4 wherein said mode indicator includes a start-up indication for the toy vehicle.

12. The method of claim 11 further comprising:

(c) detecting a set-down event of the toy vehicle when the toy vehicle engages with an operating surface after application of said number N shakes while the toy vehicle is suspended above said operating surface; and thereafter (d) actuating the toy vehicle responsive to said actuator mode upon detection of said set-down event; wherein said detecting step (c) includes detection of a state of an actuation switch of the toy vehicle that indicates that the toy vehicle has been placed appropriately to said operating surface for a run-mode.

13. The method of claim 12 wherein said actuating step (d) includes scaling an intensity of said toy vehicle actuation directly to said determining step (a).

14. The method of claim 13 wherein said actuating step (d) actuates the toy vehicle more intensely the greater said number N.

15. The method of claim 13 wherein said actuator mode determining step (a) measures a magnitude P of shakes and said actuating step (d) actuates the toy vehicle more intensely the greater the magnitude P.

16. The method of claim 13 wherein said determining step (a) determines a frequency Q of shakes and said actuating step (d) actuates the toy vehicle more intensely the greater the frequency Q.

17. A method for operating a toy vehicle, the method comprising the steps of:

(a) charging the toy vehicle by detecting, using an impulse detector coupled to the toy vehicle, application of a number N of discrete shakes to the toy vehicle, said charging setting a state of a mode indicator directly proportionately responsive to said number N discrete shakes; and thereafter (b) operating the toy vehicle responsive to said state of said mode indicator.

* * * * *